US006210568B1

(12) United States Patent
Harder

(10) Patent No.: US 6,210,568 B1
(45) Date of Patent: Apr. 3, 2001

(54) SKIMMER AND WATERFALL APPARATUS

(75) Inventor: Gary Robert Harder, Lake Mary, FL (US)

(73) Assignee: Leisure Bay Industries, Incorporated, Orlando, FL (US)

( * ) Notice: Subject to any disclaimer, the term of this patent is extended or adjusted under 35 U.S.C. 154(b) by 0 days.

(21) Appl. No.: 09/545,098

(22) Filed: Apr. 6, 2000

(51) Int. Cl.[7] ..... E04H 4/12
(52) U.S. Cl. ..... 210/169; 210/242.1; 4/507
(58) Field of Search ..... 210/169, 194, 210/292.1, 416.2; 4/507

(56) References Cited

U.S. PATENT DOCUMENTS

| | | | | |
|---|---|---|---|---|
| 3,063,077 | | 11/1962 | Pansini . | |
| 3,616,918 | | 11/1971 | Simsbury et al. . | |
| 3,693,800 | | 9/1972 | Stanfield et al. . | |
| 4,518,495 | | 5/1985 | Harding . | |
| 4,640,784 | * | 2/1987 | Cant | 210/169 |
| 4,801,378 | | 1/1989 | Desioyaux et al. . | |
| 4,820,411 | | 4/1989 | Lempio . | |
| 4,823,837 | | 4/1989 | Frentzel . | |
| 5,089,118 | * | 2/1992 | Mahoney | 210/292.1 |
| 5,139,660 | | 8/1992 | Lourie et al. . | |
| 5,143,605 | | 9/1992 | Masciarelli . | |
| 5,167,805 | | 12/1992 | Theiss . | |
| 5,228,999 | | 7/1993 | Yang . | |
| 5,269,913 | | 12/1993 | Atkins . | |
| 5,309,581 | * | 5/1994 | Lockwood et al. | 4/507 |
| 5,336,400 | | 8/1994 | Patrice . | |
| 5,342,513 | | 8/1994 | Wall et al. . | |
| 5,510,020 | | 4/1996 | Gronlund . | |
| 5,518,611 | * | 5/1996 | Bresolin | 210/169 |
| 5,584,991 | * | 12/1996 | Wittstock et al. | 210/169 |
| 5,720,056 | * | 2/1998 | Aymes | 4/507 |
| B1 4,501,659 | | 9/1986 | Henk . | |

* cited by examiner

*Primary Examiner*—Christopher Upton
(74) *Attorney, Agent, or Firm*—Holland & Knight LLP; David G. Maire, Esq.

(57) ABSTRACT

A combination skimmer and waterfall apparatus for use with a pool or spa. A skimmer is provided with a waterfall supply opening operable to deliver a flow of waterfall water into the skimmer interior at a location above the surface of the water of the pool or spa. A channel, preferably attached to a lid of the skimmer, directs the flow of waterfall water from the waterfall supply opening to a location proximate a top portion of the skimmer inlet opening to the pool or spa. The flow of waterfall water is then directed downward to form a pleasing waterfall effect in front of the skimmer. A source of light may be disposed within the skimmer interior to provide a back light for the waterfall. The width of the waterfall may be somewhat less than the width of the skimmer inlet opening. Waterfall operation and flow rate may be controlled independently from the normal recycle flow through the pool/spa pump and filter.

23 Claims, 2 Drawing Sheets

SKIMMER AND WATERFALL APPARATUS

BACKGROUND OF THE INVENTION

This invention relates generally to the field of pools and spas, and more particularly, to a combination skimmer and waterfall apparatus for use with a pool or spa.

Recreational water devices such as pools and spas are well known in the art. The term pool generally applies to larger bodies of water useful for swimming, while the term spa generally applies to smaller bodies of water useful for soaking. While pools may be heated to avoid chilling effects, the water in a spa is generally heated to an elevated temperature in order to produce a warming effect. A self-standing spa capable of being heated to an elevated temperature may also be referred to as a hot tub. A spa may be constructed adjacent a pool such that pool water that is recycled through a filter/heater may be reintroduced to the pool through the spa. Pool/spa combinations are often constructed to include a waterfall there between. Waterfalls of various designs have been used with pools and spas because of their pleasing aesthetic effect. It is also known to provide decorative lighting in combination with a waterfall in order to provide a pleasing visual effect.

Any structure containing a body of water is prone to collect debris along the surface of the water. Various designs of skimmers are known in the art for drawing a portion of the water from proximate the surface of a pool or spa through a filter in order to collect such floating debris. Current skimmer designs typically utilize a small compartment formed adjacent to the wall of a pool or spa. A floating inlet structure is provided within the skimmer compartment and is connected to a pump in order to draw off a flow of water from near the surface of the pool or spa. Access to the skimmer interior is normally provided via a top opening which is covered with a lid during normal operation of the skimmer. Although the lid may provide a pleasing appearance when viewed from above, the appearance of a skimmer when viewed from at or near water level, or from the opposite side of the pool/spa, is less appealing due to the appearance of the mechanical structures located within the interior of the skimmer. Furthermore, some skimmer designs produce a displeasing sound pattern resulting from the movement of the floating intake apparatus.

BRIEF SUMMARY OF THE INVENTION

Thus, there is a particular need for a skimmer for a pool or a spa that has a more pleasing visual design. Accordingly, an apparatus is disclosed herein apparatus for use with a spa or pool, the apparatus comprising a housing defining an interior cavity; a skimmer inlet opening formed in the housing and operable to permit a flow of water into the interior cavity when the housing is disposed proximate the surface of a body of water; a skimmer outlet opening formed in the housing, the skimmer outlet opening operable to permit a flow of water out of the interior cavity; a waterfall supply opening formed in the housing and operable to pass a flow of waterfall water into the interior cavity; and a channel having a first edge disposed proximate the waterfall supply opening and a second edge disposed proximate a top portion of the skimmer inlet opening, the channel operable to direct the flow of waterfall water to form a waterfall proximate the skimmer inlet opening.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
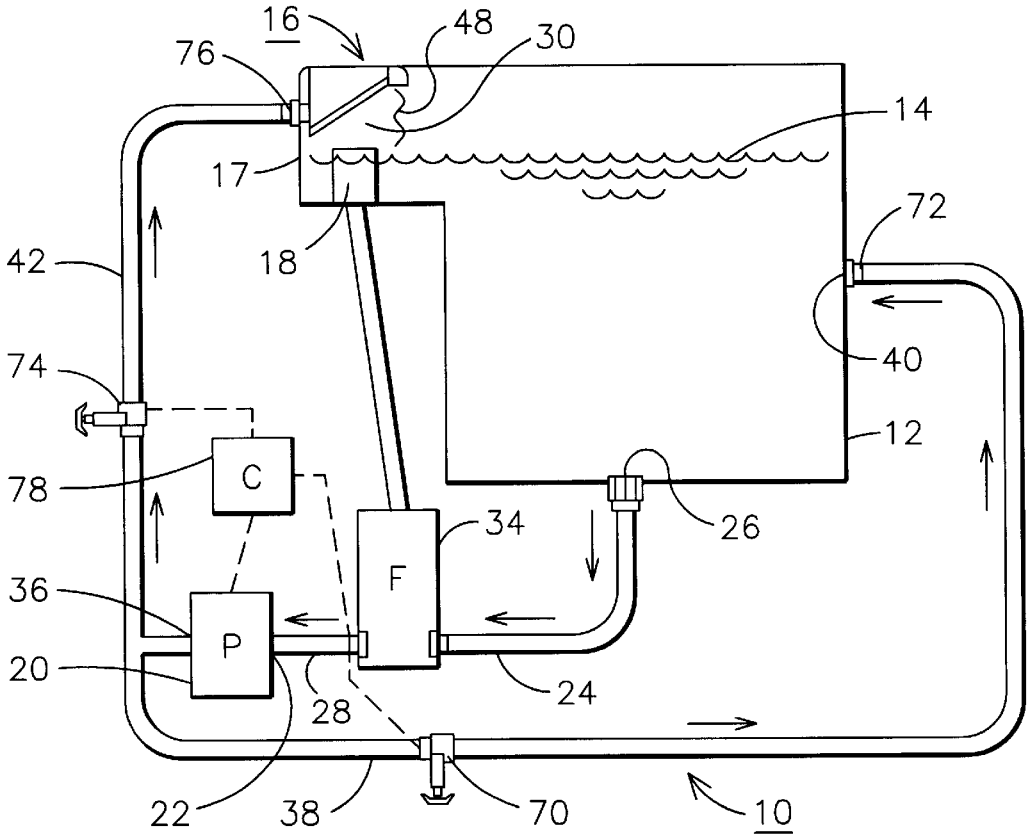
FIG. 1 is a schematic illustration of a water spa incorporating a skimmer having a waterfall feature.

FIG. 1 is a schematic illustration of a water apparatus 10 incorporating a structure 12 adapted to contain water 14 within its interior. The structure 12 may be any such structure known in the art, such as a pool, spa, hot tub, etc. The structure 12 may be a prefabricated fiberglass unit as is known for use with small spas, or it may be a large masonry or plastic unit that is assembled in place, such as is known in the field of swimming pool construction.

Figure 2:
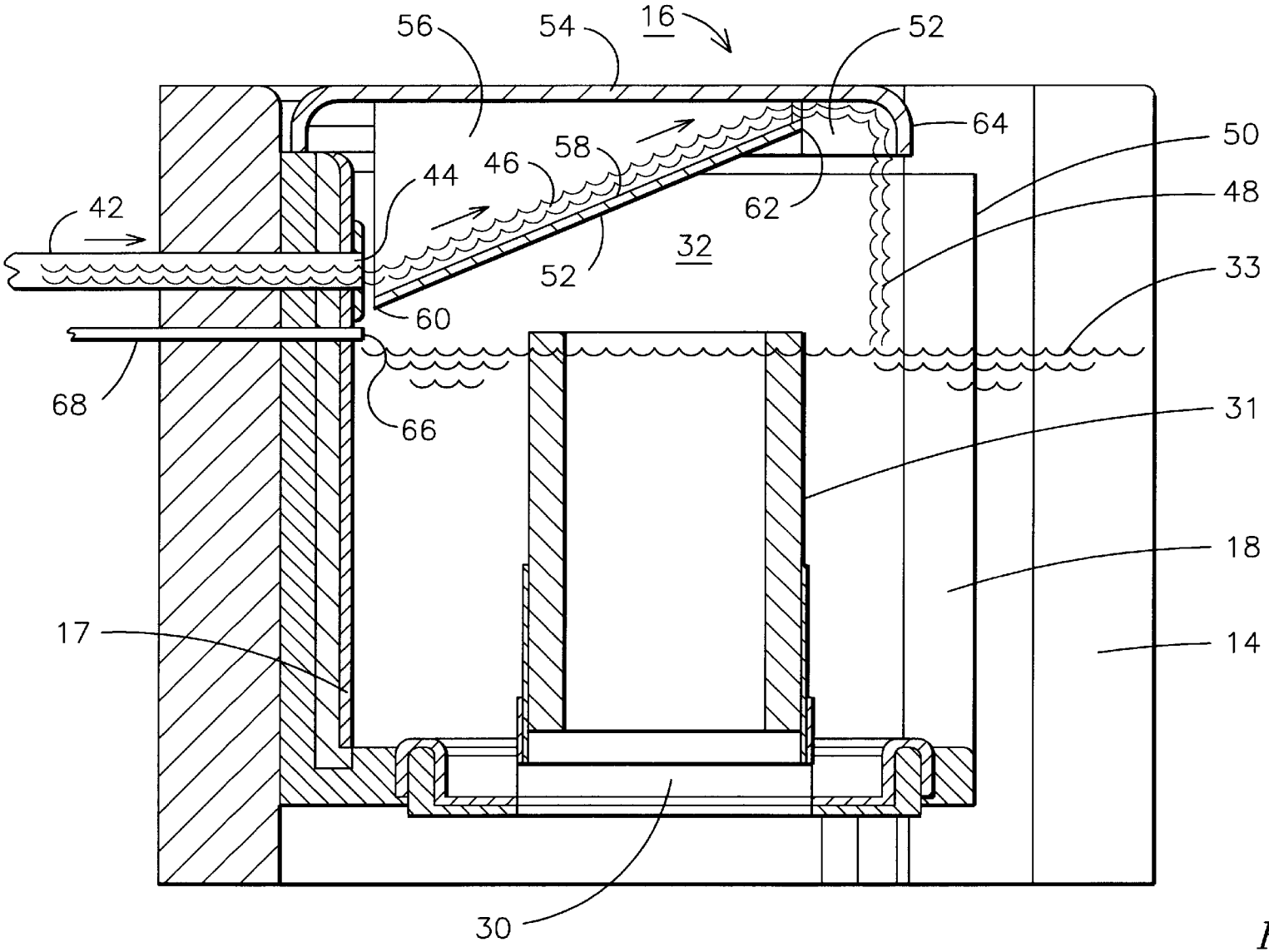
FIG. 2 is a cross-sectional view of the skimmer of FIG. 1.

A skimmer/waterfall assembly 16 is disposed proximate the structure 12. The assembly 16 includes a housing 17 that may be a prefabricated unit or may be assembled in-situ during the construction of structure 12. Housing 17 has a skimmer inlet opening 18 in fluid communication with the water 14 contained within the structure 12. A pump 20 is connected to have its inlet 22 in fluid communication with both the structure 12 and the housing 16. Pipe 24 is connected between the pump inlet 22 and a drain opening 26 formed in the bottom of structure 12. As may be seen more clearly by viewing FIG. 1 together with FIG. 2, pipe 28 is connected between the pump inlet 22 and a skimmer outlet opening 30 formed in housing 17. A floating extension tube 31 is used to place skimmer outlet opening 30 in fluid communication with the surface 33 of water 14 within the interior cavity 32 of assembly 16. Other weir types may also be used, such as a floating hinged weir, a floating guillotine weir, or a stationary slotted weir. A filter 34 may be placed upstream of the inlet 22 of pump 20 in order to remove undesirable particulate and/or chemical matter from water drawn through pump 20. A filter 34 may alternatively be placed in any one or more of the lines 24, 28, 38, 42. The outlet 36 of pump 20 is connected by pipe 38 to an opening 40 in structure 12. Opening 40 may be used to create a desirable whirlpool effect for applications where the structure 12 is a spa or hot tub. The outlet 36 of pump 20 is also connected via pipe 42 to a waterfall supply opening 44 formed in the housing 16. Pipe 42 is operative to deliver a flow of waterfall water 46 through the waterfall supply opening 44 to the interior cavity 32 of the housing 16. The flow of waterfall water 46 is directed within the interior cavity 32 to the upper portion 50 of skimmer inlet opening 18, where it drops by gravity to form waterfall 48. A channel, such as plate 52, is used to direct the flow of waterfall water 46 within the interior cavity 32. In other embodiments, not shown, the channel may be a tube, a conduit, a half pipe, or other structure providing a means for conveying the flow of waterfall water 46 from the waterfall supply opening 44 to the top portion 50 of the skimmer inlet opening 18.

Figure 3:
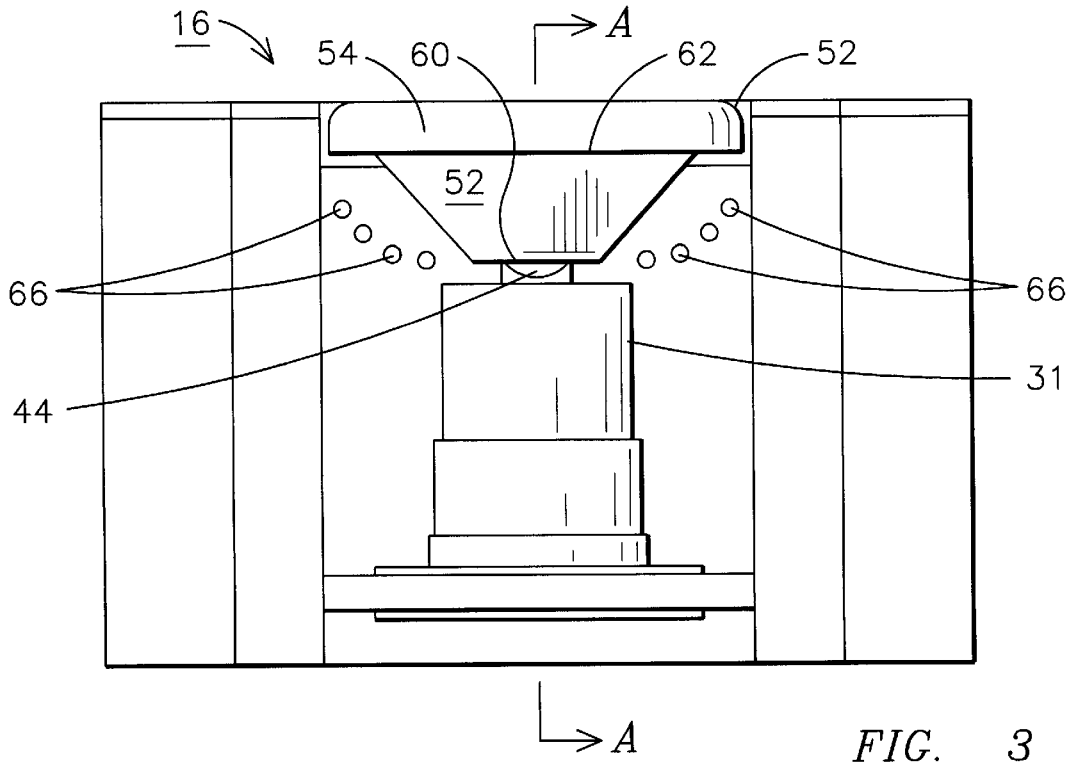
FIG. 3 is a front view of the skimmer of FIG. 1.

Skimmer housing 16 may include a top access opening 52 which is removably covered by lid 54. Advantageously, plate 52 may be attached to and supported from lid 54 by one or more supports such as support plate 56. A pair of support plates 56 may be attached between the lid 54 and the plate 52 along opposed edges of plate 52, thereby providing an unobstructed flow path for the flow of waterfall water 46 to travel along a top surface 58 of plate 52. As may be seen more clearly in FIG. 3, which is a front view of assembly 16, plate 52 may have a generally trapezoidal shape having a first smaller edge 60 disposed proximate the waterfall supply opening 44, and a second longer edge 62, generally parallel to edge 60, disposed proximate the top portion 50 of skimmer inlet opening 18. By providing a smooth, upwardly sloping and expanding surface 58 for conveying the flow of waterfall water 46, plate 52 is effective to provide a nearly laminar flow of water at edge 62 to form waterfall 48. Lid 54 may further have a downwardly curved edge 64 disposed proximate the plate second edge 62 to further direct the flow of waterfall water 46 in a downward direction to form the waterfall 48.

A source of light may be installed within the skimmer/waterfall assembly 16. An end 66 of an end-emitting fiber optic cable 68 may be disposed within the interior cavity 32 to direct light upon a rear surface of the waterfall 48. As may be seen in FIG. 3, a plurality of such fiber optic cable ends 66 may be provided in order to create a pleasing lighting effect upon the waterfall 48. Although fiber optic cables 68 have certain known advantages for use near a recreational water structure, other sources of light may be used to provide any desired lighting effect. For example, low or high voltage versions of incandescent or halogen lamps may be used, or any type of light emitting diode (LED).

The flow of water throughout apparatus 10 may be controlled by one or more automatic or manual valves 70,72,74,76 and by the control of pump 20, as may be seen in FIG. 1. Automatic valve 70 and/or manual valve 72 may be disposed in pipe 38 or structure opening 40 to control the flow of water through pipe 38. Similarly automatic valve 74 and/or manual valve 76 may be utilized to control the flow of water through pipe 42. Valve 76 may be installed directly into waterfall supply opening 44 in the form of a spa outlet nozzle as is known in the art. Such a nozzle is operable to vary the flow from unrestricted to completely restricted by a simple manual turning operation. Access to waterfall supply opening 44, and valve 76 installed in the opening 44, may be obtained by simply removing lid 54 and its attached channel apparatus 52, 56.

Pump 20 may be operable at a plurality of speeds and may be controlled by appropriate control signals generated by user-operated controller 78. Controller 78 may be used by an operator to control the speed of pump 20 as well as the position of valves 70, 74. One may appreciate that the apparatus 10 may thereby be operated in several modes of operation. Pump 20 may be operated at a low speed to provide a periodic filtering of water 14 and simultaneously to provide a pleasing aesthetic effect by opening valves 74, 76 to generate a waterfall. The skimming effectiveness of assembly 16 may vary as a function of the rate of the flow of waterfall water 46, the height of the waterfall 48, and the relative widths of the waterfall 48 and the skimmer inlet opening 18. The second edge 62 of plate 52 may have a smaller width than the width of the skimmer inlet opening 18, thus, the width of waterfall 48 may also be less than the width of skimmer inlet opening 18. In this manner, floating debris will be able to bypass the waterfall 48 and be drawn into the skimmer outlet opening 30. Thus, during this mode of operation, a pleasing visual and audible waterfall effect may be provided during the routinely necessary filtering periods.

Pump 20 may also be operated at a high speed to provide a desired whirlpool effect within water 14 proximate opening 40. As the speed of pump 20 is increased, the corresponding increase in the flow of waterfall water 46 may be utilized in full, or it may be reduced by at least partially closing at one of valves 74, 76. One may appreciate that the functionality of automatic valves 70, 74 and manual valves 72, 76 are somewhat overlapping, and therefore in some embodiments, not all of these valves may be provided. Thus, during this mode of operation, a pleasing visual waterfall effect may be provided to occupants of the spa structure 12, thereby blocking the less pleasing view of the interior 32 of assembly 16.

In any mode of operation, a pleasing visual effect may be created by the operation of the source of light 66 in order to direct light upon the waterfall 48. White or colored light, or a combination thereof, may be used in a static or dynamic display.

While the preferred embodiments of the preferred invention have been shown and described herein, it will be obvious that such embodiments are provided by way of example only. Numerous variations, changes and substitutions will occur to those of skill and the art without departing from the invention herein. Accordingly, it is intended that the invention be limited only by the spirit and scope of the appended claims.

I claim as my invention:

1. An apparatus for use with a spa or pool, the apparatus comprising:

a housing defining an interior cavity;

a skimmer inlet opening formed in the housing and operable to permit a flow of water into the interior cavity when the housing is disposed proximate the surface of a body of water;

a skimmer outlet opening formed in the housing, the skimmer outlet opening operable to permit a flow of water out of the interior cavity;

a waterfall supply opening formed in the housing and operable to pass a flow of waterfall water into the interior cavity; and a channel having a first edge disposed proximate the waterfall supply opening and a second edge disposed proximate a top portion of the skimmer inlet opening, the channel operable to direct the flow of waterfall water to form a waterfall proximate the skimmer inlet opening.

2. The apparatus of claim 1, further comprising:

a top opening formed in the housing;

a lid disposed to cover the top opening; and wherein the channel is attached to the lid.

3. The apparatus of claim 2, wherein the channel further comprises third and fourth edges extending between respective ends of the first and second edges, and further comprising a first support attached between the lid and the third edge and a second support attached between the lid and the fourth edge.

4. The apparatus of claim 2, wherein the lid further comprises a downwardly curved edge disposed proximate the channel second edge, said downwardly curved edge operable to direct the flow of waterfall water downward to form the waterfall.

5. The apparatus of claim 1, wherein the channel second edge has a width smaller than a width of the skimmer inlet opening.

6. The apparatus of claim 1, further comprising a source of light disposed within the interior cavity.

7. The apparatus of claim 1, further comprising a source of light disposed to direct light upon the waterfall.

8. The apparatus of claim 1, further comprising a valve disposed in the waterfall supply opening.

9. The apparatus of claim 1, wherein the channel further comprises a plate.

10. The apparatus of claim 9, wherein the plate comprises a generally trapezoidal shape.

11. A water apparatus comprising:

a structure adapted to contain water within its interior;

a skimmer disposed proximate the structure, the skimmer further comprising a skimmer inlet opening in fluid communication with water contained within the structure, a skimmer outlet opening, and a waterfall supply opening formed at an elevation above the surface of water contained within the skimmer;

a pump having an inlet in fluid communication with the skimmer outlet opening and an outlet in fluid communication with the waterfall supply opening, the pump operable to draw water out of the skimmer through the skimmer outlet opening and to provide a flow of waterfall water to the waterfall supply opening; and a channel disposed within the skimmer and having a first edge disposed proximate the waterfall supply opening and having a second edge disposed proximate a top portion of the skimmer inlet opening, the channel adapted to direct the flow of waterfall water from the waterfall supply opening to form a waterfall proximate the skimmer inlet opening.

12. The water apparatus of claim 11, further comprising:

a top opening formed in the skimmer;

a lid disposed to cover the top opening; and wherein the channel is attached to the lid.

13. The water apparatus of claim 11, wherein the pump inlet and pump outlet are each in fluid communication with respective openings formed in the structure.

14. The water apparatus of claim 11, further comprising a valve disposed in fluid communication between the pump outlet and the waterfall supply opening.

15. The water apparatus of claim 11, further comprising a source of light disposed within the skimmer.

16. The apparatus of claim 11, further comprising a source of light disposed to direct light upon the waterfall.

17. The apparatus of claim 11, wherein the channel further comprises a plate.

18. The apparatus of claim 17, wherein the plate comprises a generally trapezoidal shape.

19. A water apparatus having a tub portion, a skimmer disposed proximate a side of the tub portion and having a skimmer inlet opening in fluid communication with the tub portion, a pump connected to draw water to its inlet from within the skimmer and the tub portion and to deliver the water from its outlet to the tub portion, wherein the improvement comprises:

a waterfall supply opening formed in the skimmer;

a fluid connection between the pump outlet and the waterfall supply opening; and a means for conveying water from the waterfall supply opening to a top portion of the skimmer inlet opening.

20. The water apparatus of claim 19, wherein the means for conveying water further comprises a channel having a first edge disposed proximate the waterfall supply opening and a second edge disposed proximate the top portion of the skimmer inlet opening.

21. The water apparatus of claim 20, wherein the channel comprises a plate having a generally trapezoidal shape.

22. The water apparatus of claim 20, further comprising a source of light disposed within the skimmer.

23. The apparatus of claim 20, further comprising a source of light disposed to direct light upon the waterfall.

* * * * *